US005671989A

United States Patent [19]

Lautenschläger

[11] Patent Number: 5,671,989

[45] Date of Patent: Sep. 30, 1997

[54] HOLDING ARRANGEMENT FOR DRAWER BOTTOMS AT THE SIDE WALLS OF THE DRAWER

[75] Inventor: Horst Lautenschläger, Reinheim, Germany

[73] Assignee: MEPLA-Werke Lautenschläger GmbH & Co. KG, Germany

[21] Appl. No.: 747,638

[22] Filed: Nov. 13, 1996

[30] Foreign Application Priority Data

Dec. 11, 1995 [DE] Germany ..... 195 46 098.7

[51] Int. Cl.[6] ..... A47B 88/00

[52] U.S. Cl. ..... 312/348.1; 312/330.1; 312/348.2

[58] Field of Search ..... 312/348.1, 348.2, 312/348.4, 349, 330.1, 263, 283

[56] References Cited

U.S. PATENT DOCUMENTS

| | | | |
|---|---|---|---|
| 5,147,123 | 9/1992 | Benger | 312/348.1 |
| 5,172,971 | 12/1992 | Albiez | 312/348.1 |
| 5,458,413 | 10/1995 | Huber et al. | 312/348.1 X |
| 5,462,349 | 10/1995 | Grabher | 312/348.1 |
| 5,494,348 | 2/1996 | Grabher | 312/348.1 |
| 5,538,339 | 7/1996 | Rock et al. | 312/348.1 |
| 5,556,183 | 9/1996 | Brustle et al. | 312/348.1 |

FOREIGN PATENT DOCUMENTS

| | | | |
|---|---|---|---|
| 497205 | 8/1992 | European Pat. Off. | 312/330.1 |
| 2232875 | 1/1991 | United Kingdom | 312/330.1 |

*Primary Examiner*—Peter M. Cuomo
*Assistant Examiner*—James O. Hansen
*Attorney, Agent, or Firm*—Londa and Traub

[57] ABSTRACT

An arrangement for holding the bottom panel (12), which forms the bottom of a drawer, at the assigned side walls (14) of the drawer, for which the lateral edge regions of the bottom panel are in each case held seated on a supporting flange (26) protruding horizontally from the lower edge region of the side walls. In the rear end region of the side walls (14) of the drawer in the interior of the carcass, in each case an extended projection (28) protrudes upwards essentially at right angles from the supporting flange (26). An extended, groove-like recess (30), which is shaped essentially complementarily in cross section to the projection and the longitudinal extent of which is greater than the longitudinal extent of the projection, is provided in the underside of the bottom panel opposite to the projection. In the rear end surface of the extended projection, a borehole (32), extending in the pull-out direction of the drawer, is provided for accommodating the shaft of an adjusting screw (34), the head of which can be screwed down so as to contact directly or indirectly the rear end surface of the bottom panel forming the boundary of the bottom panel in the interior of the carcase.

4 Claims, 2 Drawing Sheets

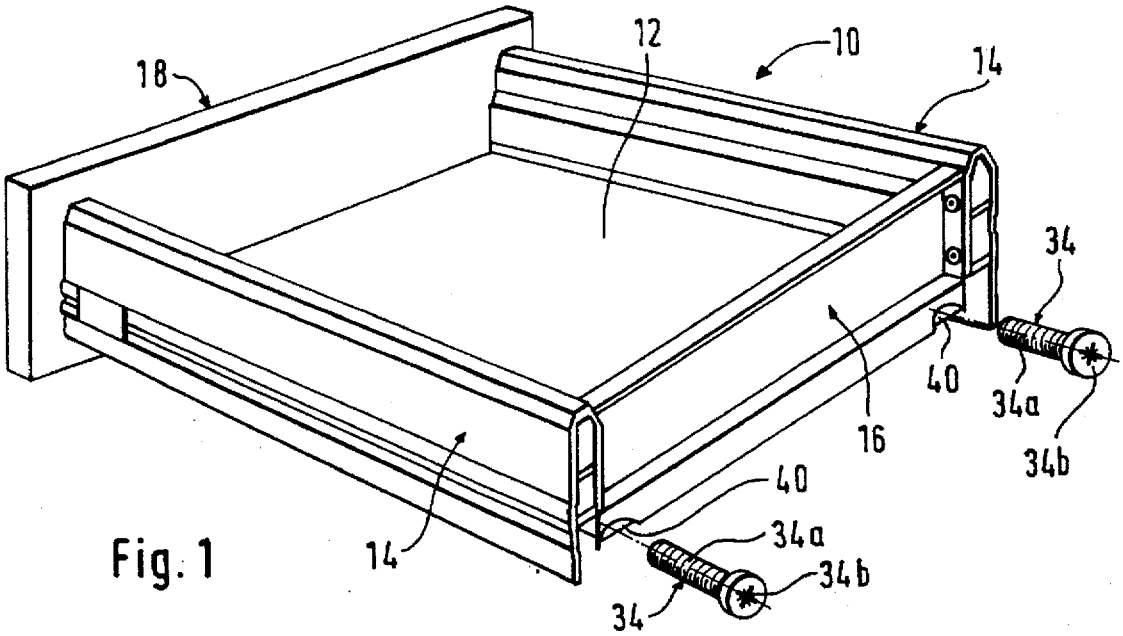
Fig. 1
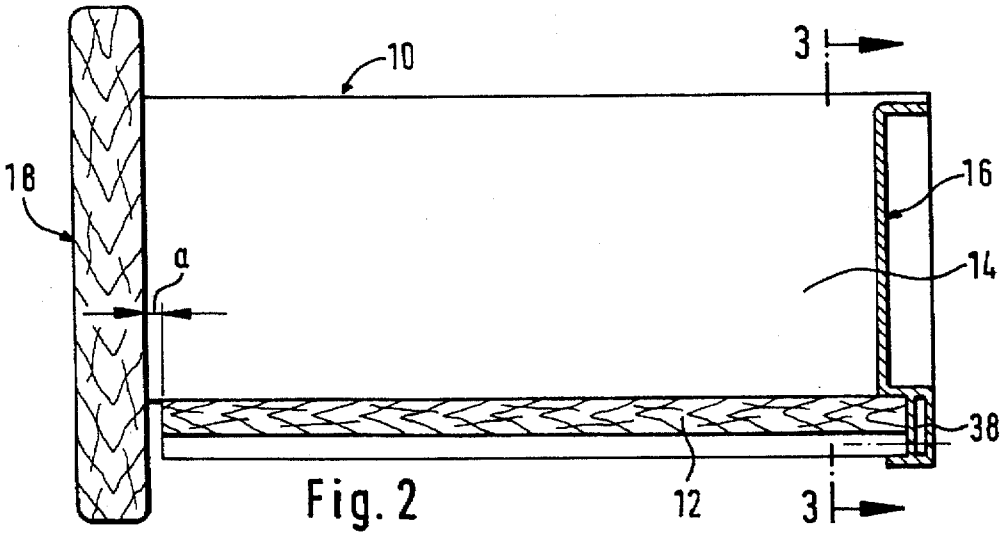
Fig. 2
Fig. 3
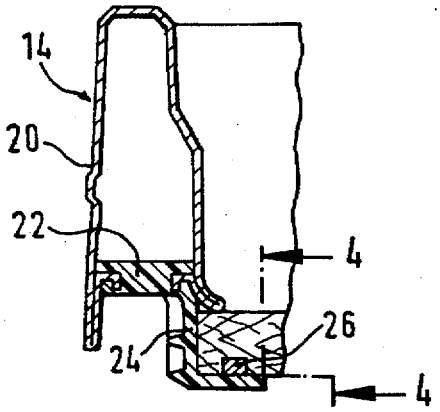

HOLDING ARRANGEMENT FOR DRAWER BOTTOMS AT THE SIDE WALLS OF THE DRAWER

The invention relates to an arrangement for holding the bottom panel, which forms the bottom of a drawer, at the assigned side walls of the drawer in such a manner, that the bottom of the drawer can be adjusted in the pulling out direction of the drawer. For this arrangement, the lateral edge regions of the bottom panel are in each case held seated on a supporting flange protruding horizontally from the lower edge region of the side walls of the drawer.

BACKGROUND

Aside from the classical wood materials, profiles of metal or plastic are also increasingly being used for the side walls or parts of the side walls of drawers of furniture produced currently. Metal side-wall profiles can, for example, be extruded from aluminum or stamped out and bent from sheet metal. Plastic side wall profiles usually are extruded and cut to the desired length or also produced by injection molding. Finally, side wall profiles with a double-wall upper profile section of bent sheet metal and open at the underside and a lower plastic profile section, inserted in the open underside of the upper profile section, manufactured separately and connected with the upper profile section are known (German patent 42 00 581). For such side wall profiles, the bottom, which usually still is made from wood, is placed on a strip-like projection or supporting flange protruding integrally from the side wall profile or inserted in the space between two strip-like projections, which are offset in the height direction by the magnitude of the thickness of the bottom. Even if, for additionally connecting the bottom to the side walls, a so-called harpoon cross member, that is, a horizontal fastening strip, provided on both flat sides with parallel anchoring ribs, which are saw toothed in cross section, is provided at the side wall, which horizontal fastening strip is pressed into a longitudinal groove in the end edge of the drawer bottom facing the side walls, the width dimension of which longitudinal groove being less than the thickness of the ribs measured over the tips of the saw toothed-shaped ribs, it has turned out that, in isolated cases under certain unfavorable circumstances, the fastening of the bottom to the side walls can become critical. Moreover, it was observed that, in the case of drawers, which are opened frequently and closed again with impetus and which are loaded with weighty contents, as a result of the impact resulting when the front facing of the drawer strikes the carcass of the cabinet, cupboard or wardrobe, there may be migration of the drawer bottom in the closing direction of the drawer. This migration cannot be avoided reliably by the aforementioned harpoon cross members.

Particularly when the dimensions of the drawer bottom are such that there is some play between the front facing and the rear wall, it may happen that a gap will open up between the inside of the front facing and the bottom of the drawer. Not only is such a gap unattractive, but objects contained in the drawer may fall out through it or be jammed in it.

It is an object of the invention to provide an arrangement for holding the bottom of the drawer in the side walls of an associated drawer, which arrangement enables the bottom of the drawer to be held in the side walls of the drawer in such a manner, that migration of the drawer bottom relative to the side walls is precluded even if the drawer is subjected to a high load or to shocklike stresses, it being possible to align the bottom in the drawer in such a manner that the front edge of the drawer makes a gap-free contact with the front facing.

SUMMARY OF THE INVENTION

Pursuant to the invention, this objective is accomplished owing to the fact that, in the rear end region of the side walls of the drawer in the interior of the carcase, in each case an extended projection protrudes upwards essentially at right angles, that an extended, groove-like recess, which is shaped essentially complementarily in cross section to the projection and the longitudinal extent of which is greater than the longitudinal extent of the projection, is provided in the underside of the bottom panel opposite to the projection. In the rear end surface of the extended projection, a borehole, extending in the pull-out direction of the drawer, is provided for accommodating the shaft of an adjusting screw, the head of which can be screwed down so as to contact directly or indirectly the rear end surface of the bottom panel forming the boundary of the bottom panel in the interior of the carcase. In contrast to the attempts pursued in the state of the art to fix the drawer bottom as immovably as possible to the side walls, the drawer bottom is placed pursuant to the invention, that is, movably on the supporting flanges of the side walls. This is now possible by means of the inventively provided adjusting means to shift the drawer bottom by means of the adjusting screw so that it is held between the side walls without play and without a gap, as desired.

If the side walls of the drawer are to be produced of plastic at least in the area of their flange supporting the bottom panel, it is advisable to construct the extended projection as an integral part of the respective supporting flange. This possibility thus consists for plastic side walls, which are constructed by injection molding or also in the case of the above-mentioned double-wall side wall profiles, which are bent from sheet metal and closed off at their underside by a plastic profile section.

The borehole in the projection, into which the adjusting screw can be screwed, can be constructed as a smooth borehole, the boundary of which is circular in cross section and the diameter of which is smaller than the diameter of the shaft of the adjusting screw, measured at the top of the threads. During the installation and adjustment of the bottom panel, the adjusting screw itself then cuts the counter-thread in the projection consisting of plastic.

The length of the groove-like recess in the underside of the bottom panel can be limited to correspond to the length of the strip-like projection as well as to correspond to the anticipated adjustment length required. In a preferred further development of the invention, the embodiment, however, is such, that the groove-like recess in the underside of the bottom panel extends essentially over the whole length of the bottom panel. This offers the possibility, not only in the rear, strip-like projection but also in the front region of the supporting flange, of providing one projection or several projections, which engage the groove-like recess and stabilize the connection between the bottom panel of the drawer and the side walls with respect to the horizontal forces acting at right angles to the pull-out direction.

The diameter of the head of the adjusting screw advisably is larger than the width and/or the depth of the groove-like recess in the bottom. This ensures that the underside of the head of the adjusting screw, facing the bottom, is supported at the rear end edge of the bottom panel in the interior of the carcass and, during the screwing-in of the adjusting screw into the borehole in the projection, pulls the bottom panel in the direction of the front facing.

On the other hand, if the head of the fastening screw is not larger or only slightly larger than the corresponding cross-sectional dimensions of the groove-like recesses, an additional washer, which enlarges the contacting area, can also be provided between the head of the adjusting screw and the rear end surface of the bottom panel.

BRIEF DESCRIPTION OF THE DRAWINGS

The invention is described in greater detail in the following description of an example in conjunction with the drawing, in which FIG. 1 shows a perspective representation of a drawer, which may be provided with the inventive holding arrangement for the bottom panel, the adjusting screw for the bottom panel being shown at a distance from the rear wall of the drawer before it is screwed in, FIG. 2 shows a sectional view through the drawer shown in FIG. 1 in a sectional plane placed parallel to the pushing-in direction through one of the extended, groove-like recesses in the bottom panel of the drawer, FIG. 3 shows a sectional view, seen in the direction of the arrows 3—3 in FIG. 2.

DETAILED DESCRIPTION

Figure 4:
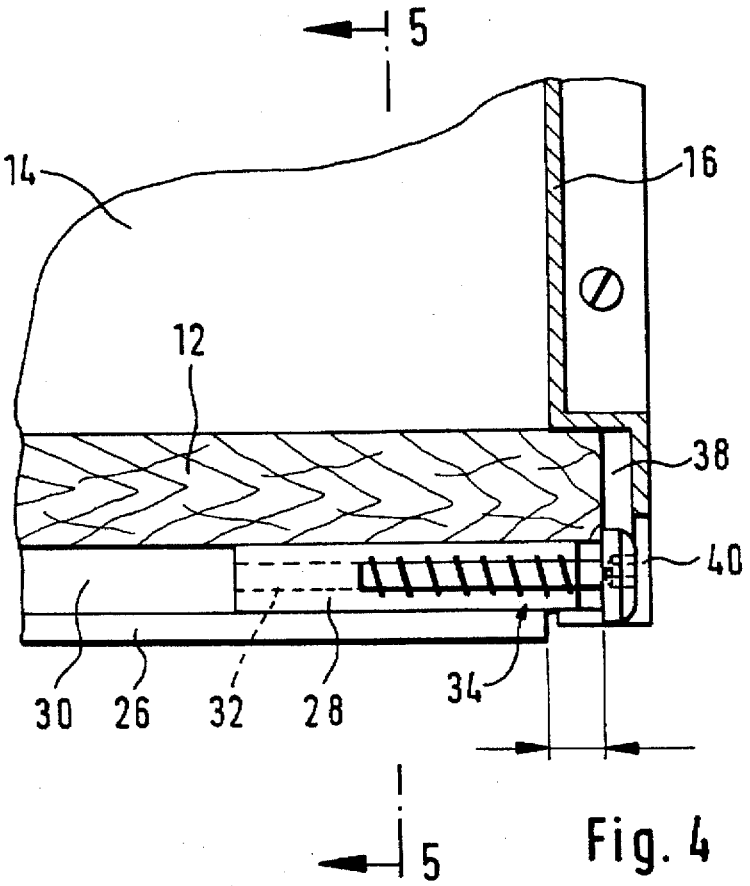
FIG. 4 shows a sectional view through the rear corner region in the sectional representation indicated by the arrows 4—4 in FIG. 3
Figure 5:
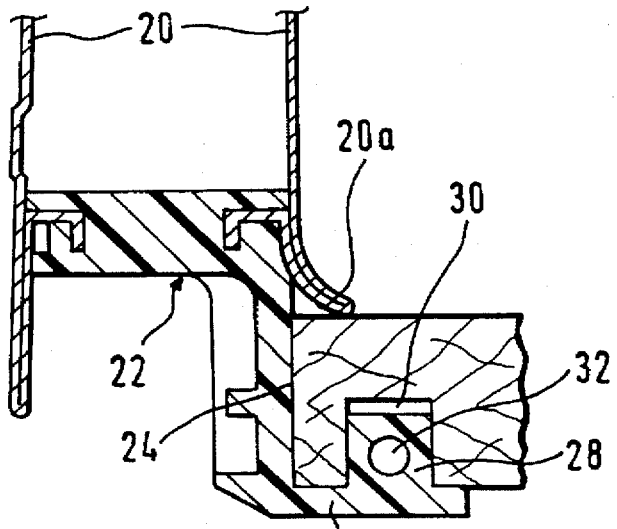
FIG. 5 shows sectional view along the arrows 5—5 of FIG. 4.

The drawer, shown in FIGS. 1 to 3 and labeled 10 as a whole, has a bottom panel 12, which functions as a bottom and is joined at its lateral longitudinal edges to side walls 14. At the rear, the space between the side walls 14 is closed off by a rear wall 16, which is fastened, in the case shown, to the side walls and, at the front, the space is closed off by the usual front facing 18, the dimensions of which are such that the facing protrudes all around over the side walls and the bottom. In the case shown, the side walls 14 are composed of a double-wall profile section 20, open at the underside and bent from sheet metal and of a plastic profile section 22, which is inserted in the region of the open underside and which, for example in the manner known from the German patent 42 00 581, is connected with the metal profile section 20, so that the side walls 14 have a cavity open only at the end sides. For holding the bottom panel 12, a supporting flange 26, on which the side edges of the bottom panel 12 are seated, in each case is integrally molded to a vertical leg 24 of the plastic profile section 22.

The lower edge region 20*a* of the material section of the drawer forming the profile section 20, is shaped into an arched, rounded off throat. By means of this lower edge region 20, the installed bottom panel is prevented from lifting off from the supporting flanges 26. However, a shifting of the bottom panel 12 in the pull-out or push-in direction of the drawer is reliably prevented with this only if the bottom panel is dimensioned in the pull-out direction so precisely, that the end edges at the front facing and the rear wall lie against the front facing and the rear wall respectively without clearance. In practice, this condition is not fulfilled in many cases, so that the bottom panel 12 of the drawer, as a consequence of the impact between the front facing and the carcase of the cabinet, cupboard or wardrobe resulting from closing the drawer with impetus, can be shifted rearward in the direction of the rear wall, as a result of which the gap, labeled a in FIG. 2, opens up between the bottom panel 12 and the front facing 18.

In order to prevent the formation of such a gap, the inventive holding arrangement, described below, is provided and makes it possible to prevent the formation of the described gap by the holding arrangement, which is provided pursuant to the invention and is equipped with an adjusting mechanism.

The inventive holding arrangement, which enables the bottom panel 12 to be adjusted in the pull-out direction of the drawer, has at its end region within the carcase an elongated projection 28, which protrudes integrally from the supporting flange 26 of each side wall 14 and engages in each case an assigned recess 30 milled groove-like into the underside of the bottom panel 12 parallel to the side edges of the latter. The projection 28 is constructed to correspond to the cross section of the recess 30, however, with little clearance. A borehole 32, which opens up into the end face of the projection 28 in the interior of the carcase and into which an adjusting screw can be screwed, is provided in the projection 28. The threaded shaft 34*a* of the adjusting screw 34, the external diameter of which is larger than the diameter of the borehole 32, cuts a counter-thread in the borehole 32 when the shaft 34*a* of the adjusting screw 34 is screwed for the first time into the borehole 32. By screwing the adjusting screw 34 into the borehole 32, the head 34*b* of the adjusting screw 34 comes to lie against the rear end edge of the bottom panel 12. As the adjusting screw 34 is screwed in further, a force, which attempts to shift the bottom panel in the direction of the front facing, is exerted by the head 34*b* on the bottom panel 12. If there is a gap between the front end edge of the bottom panel 12 and the front facing, this gap can be closed by tightening the adjusting screw 34. Since the slope of the threads of normal self-tapping screws is selected so that the screws are held by self-locking in the assigned accommodating borehole, there usually is also no danger that the lodgment of the shaft of the adjusting screw will become loose in the borehole as a result of shocklike stresses and the threaded shaft will gradually turn back. Nevertheless, additional, conventional screw-locking devices can, of course, be provided. These may be, for example, spring washers or lock washers. In order to transfer the adjusting force over a larger contacting surface to the end edges of the bottom panel 12 in the interior of the carcase, it may also be advisable to provide a plain washer, which enlarges the area of contact at the end edge of the bottom panel, below the head 34*b* of the fastening screws. In the case of the example described, the rear wall 16 of the drawer 10 is made from sheet metal, which is bent in its lower edge region in such a manner, that a fitting seat 38 (FIGS. 2 and 4) for the rear edge region of the bottom panel 12 results. Even if the bottom panel 12 is shifted in the direction of the front facing 18 in order to close the gap a, the rear end of this panel 12 does not come out of the seat 38, that is, a gap is not formed between the rear wall 16 and the bottom panel 12 of the drawer.

In the region above the heads 34*b* of the fastening screws 34, recesses 40 are provided in the seat 38 and permit the edge of a screwdriver to be applied to the head 34*b* of the fastening screw 34.

It can be seen that, within the scope of the inventive concept, modifications and further developments of the example described, which relate, for example to the design of the side wall, can be realized. For example, it can be seen that the inventive holding arrangement can also be realized for side walls consisting entirely of plastic. On the other hand, side walls of metal, whether they be extruded cavity side walls or simple sheet metal walls bent from steel sheet, can also be formed further in the inventive manner, in which case a specially produced projection, corresponding to the extended projection 28, is fastened on the supporting flange, which consists of metal and corresponds to the supporting flange 26. Deviating from the representation of FIG. 4, the extended projection 28 can also extend over the whole length of the supporting flange 26. In this case, the groove-like recess must also extend over the whole length of the bottom panel. Beyond the adjustability of the bottom panel 12, an additional stabilization of the connection between the bottom panel and the side walls 14 is then attained.

What is claimed is:

1. An arrangement for holding a bottom panel of a drawer at side walls of the drawer, such that the bottom panel is adjustable in the pulling-out direction of the drawer, comprising;

a supporting flange, for attachment with a lower edge region of the drawer side walls and which protrudes substantially horizontally from said lower edge region, and configured to seatably receive lateral edge regions of the bottom panel, an extended projection, protruding upward substantially at right angles from the supporting flange, located adjacent a rear end region of the side walls, for receiving an extended, groove-like recess in the underside of the bottom panel which is shaped substantially complementarily in cross-section to the extended projection, an adjusting screw, having a head, a threaded section having a top part and a shaft, and a borehole, in a rear end surface of the extended projection, extending in the pull-out direction of the drawer, for accommodating the shaft of the adjusting screw, the head of which can be screwed down so as to contact directly or indirectly a rear end surface of the bottom panel forming a boundary of the bottom panel, and wherein the diameter of the head of the adjusting screw is larger than the width or depth, or both, of the cross-section of the extended projection.

2. The holding arrangement of claim 1, wherein the extended projection is an integral part of the supporting flange.

3. The holding arrangement of claim 2, wherein the borehole in the extended projection, is a smooth-walled, round borehole having a diameter which is smaller than the diameter of the shaft of the adjusting screw, measured at the top part of the threaded section.

4. The holding arrangement according to claim 1, further comprising a plain washer on the shaft of the adjusting screw adjacent the head of the screw.

* * * * *